US006539932B2

(12) United States Patent
Ohmori et al.

(10) Patent No.: US 6,539,932 B2
(45) Date of Patent: Apr. 1, 2003

(54) APPARATUS AND METHOD FOR CUTTING INGOTS

(75) Inventors: Hitoshi Ohmori, Wako (JP); Masashi Shigeto, Chiba (JP); Nobuyuki Nagato, Chiba (JP)

(73) Assignees: Riken (JP); Showa Denko K.K. (JP)

( * ) Notice: Subject to any disclaimer, the term of this patent is extended or adjusted under 35 U.S.C. 154(b) by 48 days.

(21) Appl. No.: 09/768,795

(22) Filed: Jan. 25, 2001

(65) Prior Publication Data

US 2001/0017130 A1 Aug. 30, 2001

(30) Foreign Application Priority Data

Jan. 26, 2000 (JP) ..... 2000-016518

(51) Int. Cl.[7] ..... B24B 53/07

(52) U.S. Cl. ..... 125/16.01; 125/16.02; 125/17; 125/18; 451/164; 83/746

(58) Field of Search ..... 125/16.01, 16.02, 125/17, 18; 451/56, 164; 83/746

(56) References Cited

U.S. PATENT DOCUMENTS

| | | | | |
|---|---|---|---|---|
| 4,160,397 A | * | 7/1979 | Bertini | 83/661 |
| 4,755,340 A | * | 7/1988 | Ermer | 264/261 |
| 4,930,486 A | * | 6/1990 | Kuromatsu | 125/11.01 |
| 5,150,641 A | * | 9/1992 | Werner | 83/647 |
| 5,908,025 A | * | 6/1999 | Katamachi | 125/16.02 |

FOREIGN PATENT DOCUMENTS

| | | |
|---|---|---|
| JP | 58-59566 | 4/1983 |
| JP | 62-264869 | 11/1987 |
| JP | 62-264869 A | 11/1987 |
| JP | 1-175166 | 12/1989 |
| JP | 5-104438 A | 4/1993 |
| JP | 5-104438 | 4/1993 |
| JP | 9-187815 A | 7/1997 |
| JP | 9-187815 | 7/1997 |

* cited by examiner

*Primary Examiner*—George Nguyen
(74) *Attorney, Agent, or Firm*—Griffin & Szipl, P.C.

(57) ABSTRACT

A thin strip-shaped grindstone 12 is held flat under tension and moved backwards and forwards in the longitudinal direction, while the grindstone is moved in a direction perpendicular to a cylindrical ingot 1 and cuts the ingot. A metal-bonded grindstone is used as the strip-shaped grindstone 12, at least one pair of electrodes 23 are disposed adjacent to both surfaces of the metal-bonded grindstone one on each side of the ingot. The metal-bonded grindstone is made the positive electrode and DC voltage pulses are applied between the grindstone and the electrodes, and at the same time, a conducting processing fluid 25 is fed to the gaps between the metal-bonded grindstone and the electrodes, and both surfaces of the metal-bonded grindstone are dressed electrolytically on both sides while the cylindrical ingot is being cut by the metal-bonded grindstone. A large diameter, hard, refractory ingot can be efficiently cut with a small amount of cutting waste, warping and uneven thickness of the finished surface are reduced, roughness of the cut surface is small, little damage is given to the crystal during processing, running costs are low and there is a reduction in manpower requirements.

11 Claims, 6 Drawing Sheets

APPARATUS AND METHOD FOR CUTTING INGOTS

This application claims priority from Japanese Patent Application No. 016518/2000, filed Jan. 26, 2000, the entire disclose of which is incorporated herein by reference.

BACKGROUND OF THE INVENTION

1. Technical Field of the Invention

The present invention relates to an apparatus and method for cutting ingots such as single crystal ingots of SiC etc., used in hard electronics.

2. Prior Art

Hard electronics generally means solid state electronics based on wide-gap semiconductors with physical properties better than those of silicon, such as SiC and diamond, which have harder specifications than those of silicon. The band gaps of SiC and diamond used in hard electronics are in the range of 2.5 to 6 eV compared to the 1.1 eV of silicon.

The history of semiconductors began with germanium which was succeeded by silicon with a greater band gap. A large band gap brings with it a greater chemical bonding force between the atoms that compose a substance. Therefore, physical properties required for hard electronics, such as material hardness, insulation breakdown voltages, carrier saturation drift velocities and thermal conductivities are much better than those of silicon. For example, the Johnson index for a high-speed, large-output device is one of the performance indexes used in hard electronics. As shown in FIG. 1, if the index is assumed to be 1 for silicon, those of the semiconductors used in hard electronics are a hundred to a thousand times greater.

Therefore, semiconductors based on hard electronics are considered to be very hopeful as replacements for conventional silicon semiconductors in various fields such as high energy electronics typically used for power devices, electronics for information technologies based mainly on millimeter waves and microwave telecommunications and electronics for extreme environments including nuclear power, geothermal heat and space technologies.

Of the various hard electronics materials, power devices using SiC have reached the most advanced stage of research. However, even though SiC devices are at the leading edge of research and development, because this material has a strong chemical bonding force and is very hard, there are problems in the manufacture of devices made of SiC material, and conventional technologies used for processing silicon cannot be directly applied.

That is, to manufacture a device from an ingot of single-crystal SiC, the ingot must be cut into flat wafers in the same way as is done conventionally. According to the conventional technology for processing silicon, the ingot is cut using either (1) an outer edge cutter, (2) an inner edge cutter or (3) a wire saw.

The outer edge cutter is shown typically in FIG. 2. A thin disk-shaped cutter with a cutting edge 2 is rotated at a high speed about its center shaft 2*a,* and its outer edge cuts the ingot 1. This type of cutter has been used conventionally to cut single crystals of SiC. However, with this type of cutting means, if the diameter of the ingot is 3 inches (about 75 mm), the thickness of the cutting edge is about 0.8 mm and the diameter of the disk is about 8 inches (about 200 mm). Therefore the thickness of the material lost in cutting (corresponding to the edge thickness+runout) is larger than the thickness of the product (about 0.3 mm). That is, the problem concerns the loss of a large amount of expensive single crystal SiC. In addition, the diameter of a single crystal SiC ingot has been increased to 4 inches or more (about 100 mm or more) as there is a demand for large devices and the manufacturing technology has advanced. In this case, the diameter of the cutting disk is about 10 inches (about 250 mm) and the size of the cut is about 1.0 mm, so the losses become much greater.

In addition, as the diameter of the cutting disk is large, another problem is that saw marks are produced on the cut surface.

The inner edge cutter is shown schematically in FIG. 3. A thin cutting disk 3 with a hole 3*a* at the center is rotated at a high speed, and the ingot 1 is cut by grinding material electrolytically deposited on the inner periphery. The cutting disk 3 is a metal plate with a thickness as small as 0.2 to 0.3 mm, and the outer periphery is supported by another ring member (not illustrated) in order to keep the plate flat.

With this type of cutting means, the cutting losses can be reduced in the case of an easily cut silicon ingot, because the cutting edge is thinner than the cutting edge 2 in FIG. 2. However, when a hard crystal of SiC is cut, the life of the cutting edge is short because there is only one layer of electrolytically deposited grinding particles. So there is a problem of short replacement intervals. Also, the mounting structure of the cutting disk 3 is complicated, and the installation needs skillful personnel, so that the replacement work is time-consuming. In addition, there is another problem because the operating efficiency of the cutting device is low.

With the wire saw, as illustrated in FIG. 4, a fine wire 4, 0.2 to 0.3 mm in diameter, is stretched between the guide pulleys 4a and pulled across in an endless-manner. The ingot is cut by slurry containing grinding grains supplied between the ingot 1 and the wire 4. Because this type of cutting method cuts slowly with the help of a slurry, normally a number of wafers (4 to 8 wafers) are cut simultaneously by one length of wire 4 as shown in FIG. 4.

Although this cutting means causes only a small amount of cutting losses, when a hard single crystal of SiC is cut, the wire is rapidly consumed and breaks frequently. In particular, the wire is often cut at the outer periphery of the ingot 1 because of considerable vibrations. Once the wire breaks, the single crystal of SiC being cut is totally lost, so the large loss of an ingot is the problem. Also, a single crystal sic ingot is hard and difficult to cut, so that a large amount of slurry is required, resulting in a high cost.

As described above, when a single crystal of SiC is cut, the following requirements must be satisfied.

(1) The hard, refractory single crystal of SiC must be cut efficiently.

(2) Cutting means must be applicable to a crystal with a diameter as large as 4 inches.

(3) The width of the cut should be small so that only a small amount of expensive single crystal SiC is lost during cutting.

(4) The warping of the cutting plane (that is, of the entire wafer) must be small. This warping requirement is particularly important because warping cannot be corrected during subsequent lapping etc., and the maximum amount of warping should be 30 $\mu$m or less.

(5) No saw marks.

(6) Processing damage to the crystal should be minimal.

(7) The running costs must be low.

(8) The manpower required should be low.

SUMMARY OF THE INVENTION

The present invention aims at solving the various problems and satisfying demands. In other words, an object of the present invention is to provide an apparatus and method for cutting ingots such that a large, hard and refractory ingot can be cut efficiently with a small amount of cutting losses, a small degree of warping and thickness irregularity on the finished surface, small roughness of the cut surface, minimal damage to the crystal during processing, low operating costs, and small manpower requirements.

The ingot cutting apparatus offered by the present invention is provided with a thin strip-shaped grindstone (12), a tensioning mechanism (14) that applies a tension to the above-mentioned strip-shaped grindstone to keep the grindstone flat, a reciprocating device (16) to move the strip-shaped grindstone backwards and forwards in the longitudinal direction, and a cutting device (18) that moves the strip-shaped grindstone in the direction of the diameter of the cylindrical ingot (1).

In addition, according to the present invention, a method of cutting ingots is provided. In the method, a tension is applied to thin strip-shaped grindstone (12) to maintain the grindstone flat, the strip shaped grindstone is moved backwards and forwards in the longitudinal direction, the strip-shaped grindstone is moved in the radial direction of the cylindrical ingot (1) and the ingot is cut.

According to the above-mentioned apparatus and method of the present invention, because a strip-shaped grindstone (12) is moved backwards and forwards longitudinally while cutting a cylindrical ingot (1), the ingot can be cut efficiently even if it is large in diameter and hard to cut. Compared to conventional means that use an outer or inner cutting edge disk cutter, the cutting tool (strip-shaped grindstone) is smaller and cheaper, so the running cost can be reduced. In addition, as the strip-shaped grindstone is tensioned and maintained flat, a thin strip-shaped grindstone with a thickness for example, of 0.2 to 0.3 mm can be used, so that the runout of the grindstone can be reduced. Therefore, the cutting losses can be decreased, and the warping or uneven thickness of the finished surface can also be decreased. Furthermore, because the strip shaped grindstone is more resistant to breakage than a wire, the loss of an expensive ingot (for instance, of a single crystal of SiC) can be greatly reduced.

According to a preferred embodiment of the present invention, the tensioning mechanism (14) is composed of a pair of fixing components **(14*a*) that are attached to both ends of the strip-shaped grindstone (12), and a tensioning component (14*b*) that pulls the above-mentioned fixing components in the longitudinal direction of the strip-shaped grindstone. The reciprocating device (16) is comprised of a double-action bed that drives the above-mentioned tensioning mechanism (14) backwards and forwards in the horizontal or vertical direction. The cutting device (18) is composed of a moving device that holds the ingot (1)** and drives it in a direction parallel to the plane of the strip-shaped grindstone.

This configuration simplifies the structure of the apparatus, reduces machine failures, increases the operating efficiency, reduces running costs, can be easily automated, and saves manpower.

Moreover, the above-mentioned tensioning mechanism (14) should preferably support a number of strip-shaped grindstones (12) mounted parallel to each other. Such a configuration as described above provides for multiple cutting (the ingot is cut at a number of locations simultaneously) using a plurality of strip-shaped grindstones, so the configuration can also increase the rate of cutting.

Also, the strip-shaped grindstone (12) is a metal-bonded grindstone, and is provided with at least one pair of electrodes (23) arranged on both sides of the ingot in the radial direction, separated from both surfaces of the metal-bonded grindstone, a means (22) for applying a voltage to supply DC voltage pulses to the above-mentioned electrodes with the metal-bonded grindstone as the positive electrode, and a means (24) of feeding processing fluid to supply a conducting processing fluid (25) between the metal-bonded grindstone and the above-mentioned electrodes. A minimum of one pair of electrodes (23) are arranged adjacent to both surfaces of the metal-bonded grindstone on both sides of the ingot in the radial direction. DC voltage pulses are applied to the electrodes with the metal-bonded grindstone as the positive electrode, and at the same time, conducting processing fluid (25) is supplied between the metal-bonded grindstone and the electrodes, the cylindrical ingot is cut by the metal-bonded grindstone, and simultaneously, both surfaces of the grindstone are dressed electrolytically on both sides thereof.

Using the apparatus and methods, so-called electrolytic in-process dressing grinding (ELID grinding) can be carried out, wherein an ingot is cut while both surfaces of the metal-bonded grindstone are electrolytically dressed. As a result of the electrolytic dressing, the grinding grains are sharpened, so that even a hard single crystal SiC ingot can be cut efficiently. In addition, since the surface of metal-bonded grindstone can be sharpened with a high degree of accuracy by the above-mentioned electrolytic dressing, microscopic grinding grains can be used and the cut surface can be finished to give an excellent flat surface with a near-mirror surface finish. Furthermore, the amount of subsequent processing (polishing) can be greatly reduced, and also processing damage to the crystal can be minimized.

The above-mentioned strip-shaped grindstone (12) is composed of a strip of metal (13) and a metal-bonded grindstone **(12*a*)** formed on the edge thereof by electric casting. With this configuration, a metal-bonded grindstone that can withstand the tension needed to keep the grindstone flat can be easily manufactured.

Other objects and advantages of the present invention will be revealed in the following description referring to the attached drawings.

DESCRIPTION OF PREFERRED EMBODIMENTS

Figure 1:
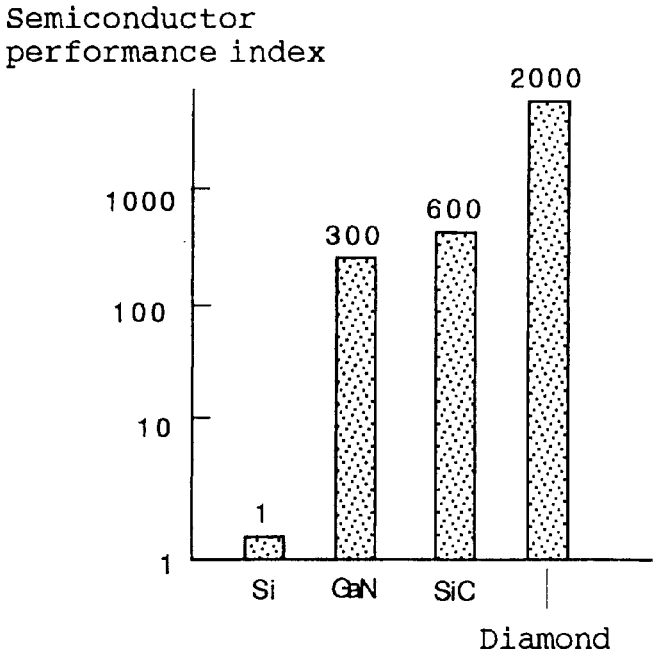
FIG. 1 compares the performance of hard electronic substances to conventional Si.
Figure 2:
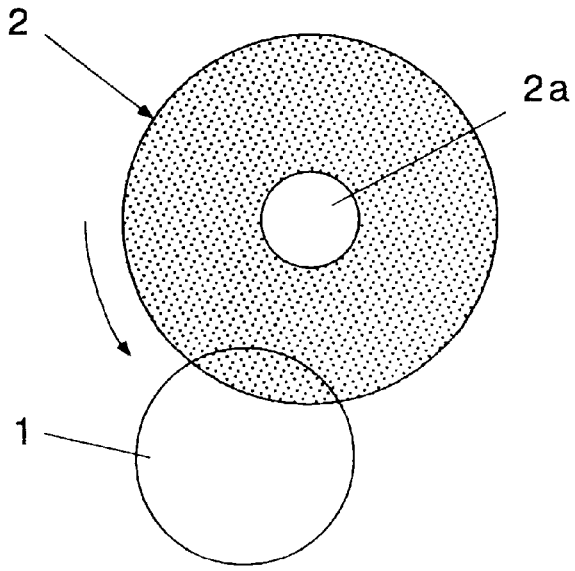
PRIOR ART Fig.2
FIG. 2 is a conceptual view of a conventional outer edge cutter.
Figure 3:
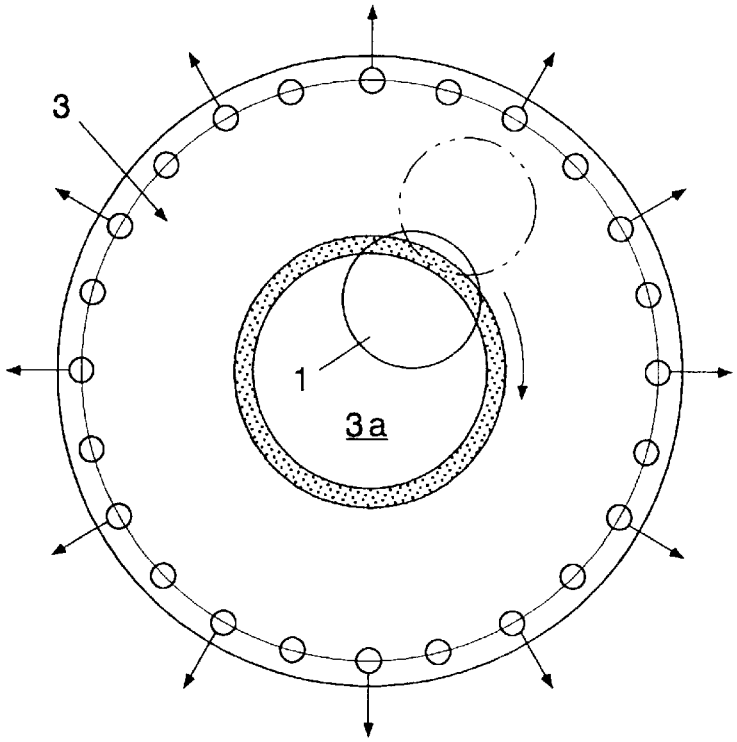
PRIOR ART Fig.3
FIG. 3 shows a conventional inner edge cutter.
Figure 4:
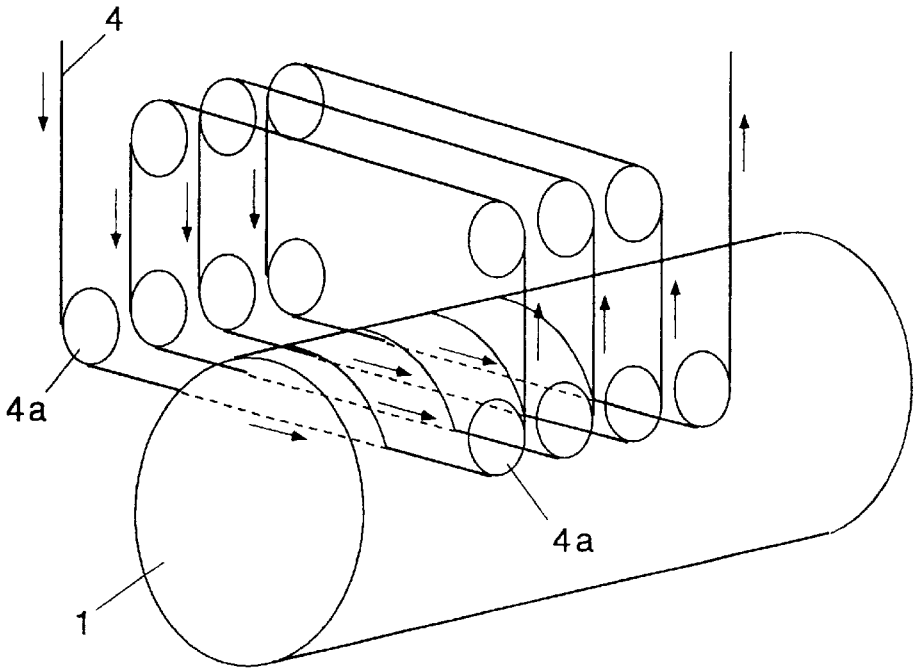
PRIOR ART Fig.4
FIG. 4 shows a conventional wire saw.

Preferred embodiments of the present invention are described below referring to the drawings. In each drawing, common portions are identified with the same reference numbers, and no duplicate description is given.

Figure 5:
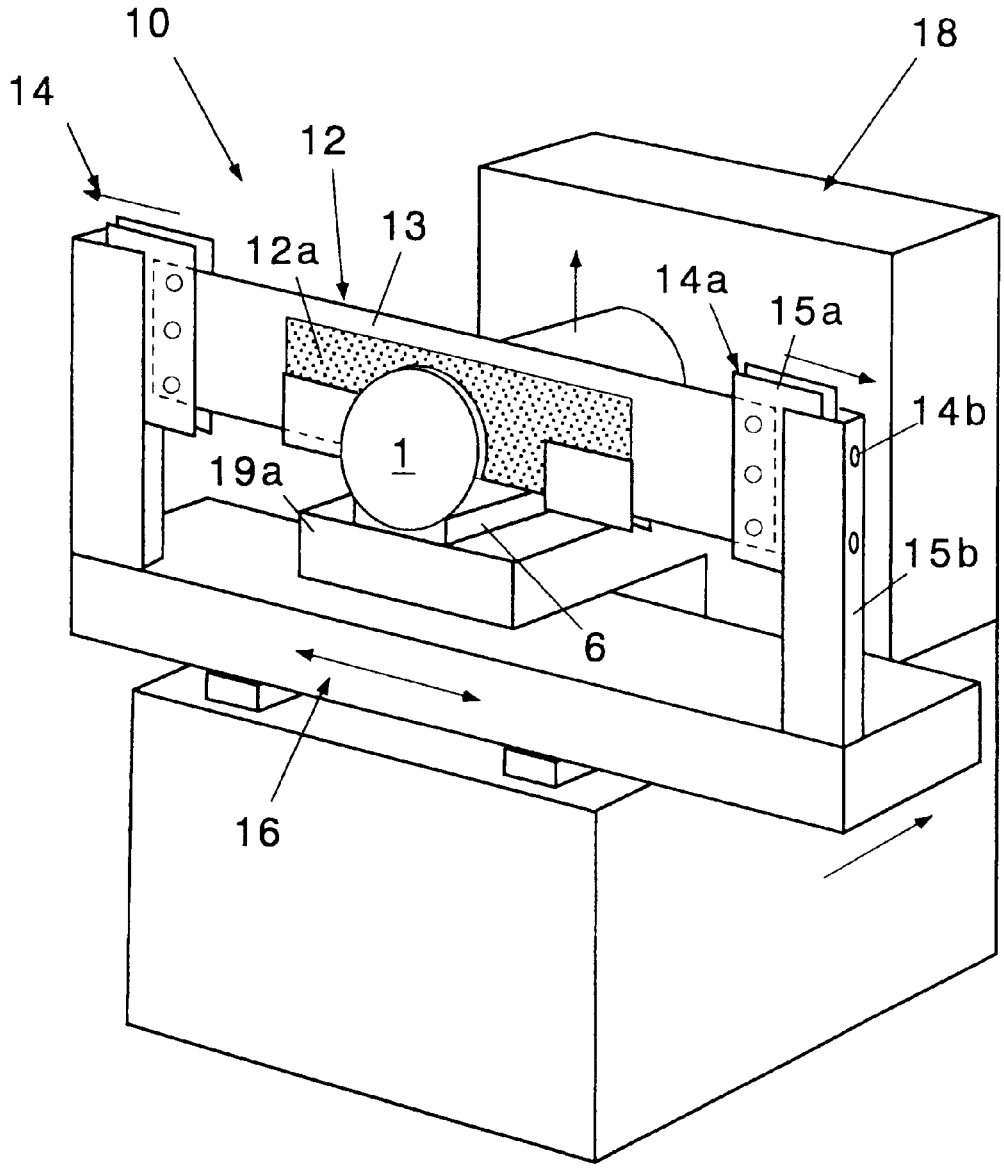
FIG. 5 is a schematic view of an ingot cutting apparatus according to the present invention.

FIG. 5 shows a typical configuration of the ingot cutting apparatus according to the present invention. In FIG. 5, the ingot cutting apparatus 10 according to the present invention is provided with a thin strip-shaped grindstone 12, a tensioning mechanism 14 that applies a tension to the strip-shaped grindstone 12 and maintains the grindstone flat, a reciprocating device 16 that moves the strip-shaped grindstone 12 backwards and forwards in the longitudinal direction, and a cutting device 18 that moves the strip-shaped grindstone 12 in the radial, or perpendicular, direction of the cylindrical ingot 1.

The cylindrical ingot 1 is, in this embodiment, a single crystal SiC ingot with an outer diameter of about 4 inches. However, the present invention is not limited to the ingot, but is applicable also to various ingots including silicon ingots.

The strip-shaped grindstone 12 is composed of a strip of metal 13 and a metal-bonded grindstone 12*a* formed along the edge thereof, in this embodiment. The strip of metal 13 is, for instance, a metal sheet as thin as 0.2 to 0.3 mm. Also, the metal-bonded grindstone 12*a* is produced by electrically casting grinding grains onto part of the strip of metal 13, and the total thickness is similar to or slightly larger than the strip of metal 13. This metal-bonded grindstone 12*a* is composed of grinding grains (for instance, diamond grinding grains) and a metal-bonding material and is formed by electric casting. The size of the grinding grains should be as small as possible for the purpose of producing an excellent flat surface with an almost mirror surface finish. For example, the preferred grain diameter is 2 $\mu$m (equivalent to granularity #8000) to 5 nm (equivalent to granularity #3,000,000) for practical applications. To increase the cutting efficiency, coarser grains such as #325 to 4 $\mu$m (corresponding to #4000) can also be used. By using coarse grinding grains, more efficient cutting can be achieved, and by using fine grinding grains, a nearly mirror surface finish can be attained.

However, the present invention should not be limited only to the embodiments described above, but the strip-shaped grindstone 12 can also be an ordinary grindstone instead of a metal-bonded grindstone.

The tensioning mechanism 14 is composed of a pair of fixing components 14a that sandwich and fix both ends of the strip-shaped grindstone 12, and a tensioning component 14*b* that pulls the strip-shaped grindstone 12 outwards in the longitudinal direction (in this example, in the horizontal direction). The fixing members 14*a* are comprised of flat plate components 15*a* in this embodiment, that hold and are fixed to both ends of the strip-shaped grindstone 12, from both sides. Through-holes are provided in the fixing components 14*a,* and both ends of strip-shaped grindstone 12 can be securely sandwiched and fixed to the flat plate components 15*a* by tightening nuts and bolts etc. inserted through the holes. The pulling components 14*b* in this embodiment are horizontal bolts that attach the vertical components 15*b* to the flat plate components 15*a*. By tightening these horizontal bolts, the flat plate components 15*a* are pulled outwards in the longitudinal direction (outwards in the horizontal direction), and the tension in the strip-shaped grindstone 12 is adjusted, thereby the strip-shaped grindstone 12 can be held in a flat condition.

The reciprocating device 16 is a double-action bed that moves the tensioning mechanism 14 backwards and forwards horizontally in this example. The pair of vertical components 15*b* are fixed on the top of the double-action bed. This double-action bed is guided by a linear guide, not illustrated, and is driven horizontally by a reciprocating device.

The cutting device 18 is, in this embodiment, a moving device that supports the ingot 1 and moves it in the direction parallel to the strip-shaped grindstone. The moving device 18 is configured with a work base 19*a* that carries the ingot 1, and a vertical drive mechanism (not illustrated) that lifts the work base 19*a* in the upward direction. In this example, a carbon block 6 is bonded to the bottom of the cylindrical ingot 1, and the carbon block. is fixed to the upper surface of the work base 19*a*.

The cutting device 18 can also be configured so as to move the strip-shaped grindstone 12 in the direction parallel to the surface thereof, instead of moving the ingot 1.

Figure 6A:
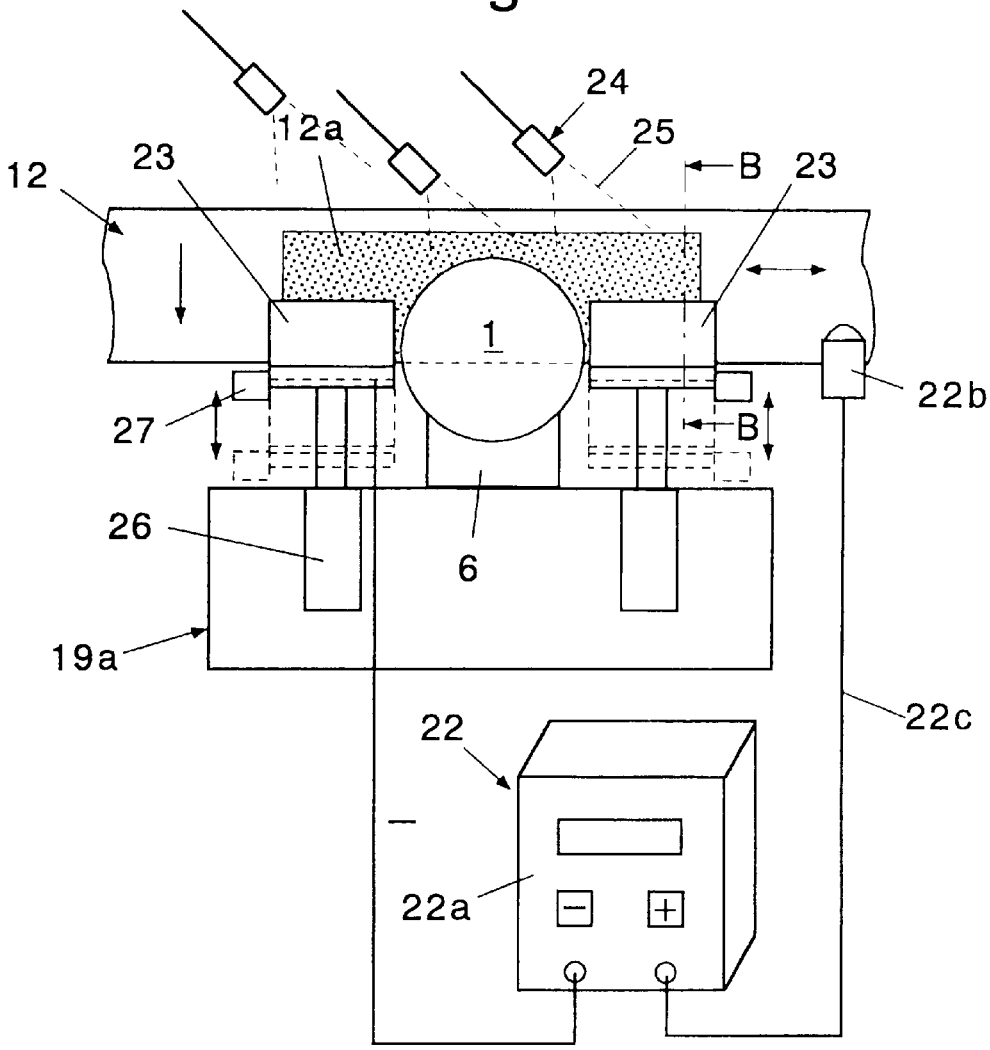
FIGS. 6A and 6B show the major components of the apparatus shown in FIG. 5.
Figure 6B:
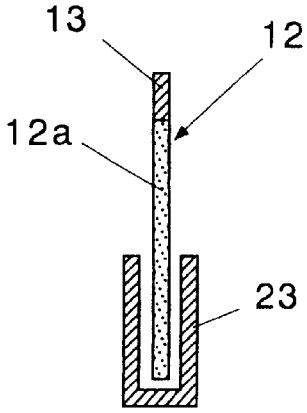

FIGS. 6A and 6B show the arrangement of the major parts shown in FIG. 5. FIG. 6A is a front view, and FIG. 6B is a sectional view along the line B—B. As shown in FIG. 6A, the ingot cutting apparatus 10 according to the present invention is further provided with at least one pair of electrodes 23, a means of applying a voltage 22, and a means of feeding processing fluid 24.

A minimum of one pair of electrodes 23, arranged one on each side of the ingot 1, are provided with a gap between the electrode and each side of the metal-bonded grindstone 12*a*. That is, in this example, a pair of electrodes 23 with U-shaped cross sections are supported by lifting devices 26 (for instance, pulsed cylinders) attached to the upper surface of the work base 19*a*. In addition, a lower-surface sensor 27 for detecting the position of the bottom of the strip-shaped grindstone 12 is fixed on the work base 19*a*. In this configuration, the position of the bottom of the grindstone is detected by the lower-surface sensor 27, and subsequently the pair of electrodes 23 are lowered by the lifting devices 26, so that the electrodes 23 on diametrically opposite sides of the ingot 1 are maintained close to the predetermined gaps from each side and the bottom of the metal-bonded grindstone 12*a*.

The means of applying a voltage 22 is composed of a power supply 22*a,* a connector 22*b,* and a power cable 22*c*. DC voltage pulses are applied between the metal-bonded grindstone 12*a* and electrodes 23, with the grindstone as the positive electrode supplied through the connector 22*b*. The power supply 22*a* should preferably be a constant-current ELID power supply that can supply DC pulses.

The means of feeding processing fluid 24 is provided with nozzles 24*a* directed towards the gaps between the metal-bonded grindstone 12*a* and the electrodes 23 and the place where the metal-bonded grindstone 12*a* contacts the ingot 1, and processing fluid lines 24*b* for feeding a conducting processing fluid 25 to the nozzles 24*a,* and supplies the conducting processing fluid 25 to the gap between the grindstone 11 and the place where it contact the ingot 1.

Figure 7A:
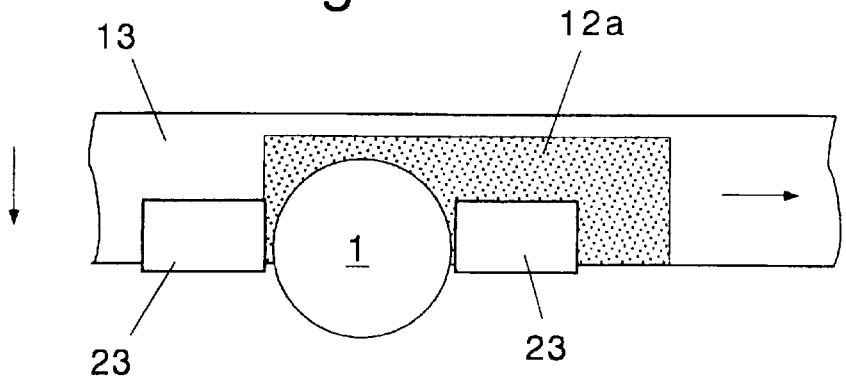
FIGS. 7A to 7C illustrate the operation of the apparatus according to the present invention.
Figure 7B:
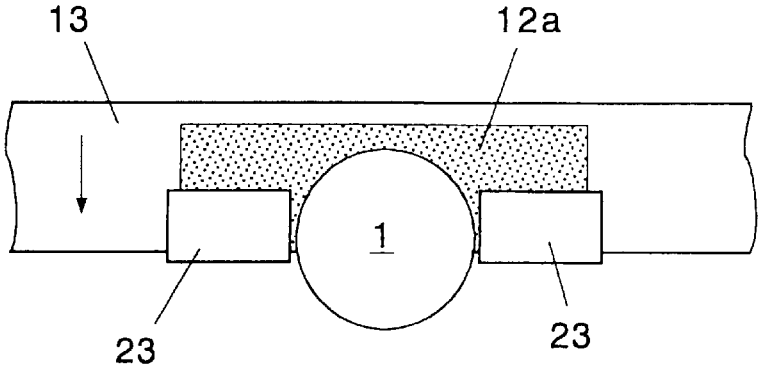
Figure 7C:
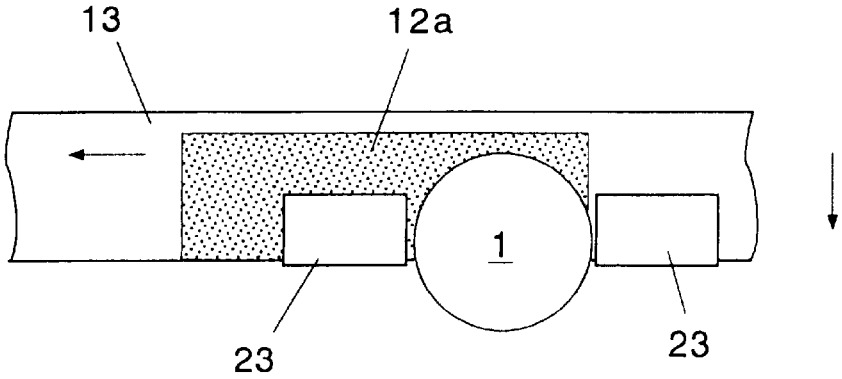

FIGS. 7A to 7C illustrate the operation of the apparatus according to the present invention. FIG. 7A shows the state in which the reciprocating device 16 has moved the metal-bonded grindstone 12*a* towards the right hand side of the figure. FIG. 7B shows an intermediate location. FIG. 7C represents the state in which it has moved to the left. That is, the metal-bonded grindstone 12*a* is given a reciprocating motion in the horizontal direction relative to the ingot 1 by the reciprocating device 16, and continuously repeats the movements as shown in FIGS. 7A→7B→7C→7B→7A.

According to the methods of the present invention using the ingot cutting apparatus 10 of the present invention, a thin strip-shaped grindstone 12 is held under tension and maintained in a flat state, and is given a longitudinal reciprocating motion as shown in FIGS. 7A to 7C, while the strip-shaped grindstone 12 is moved perpendicularly to the cylindrical ingot 1 and continuously cuts the ingot.

More preferably, a metal-bonded grindstone is used as the strip-shaped grindstone 12, and as shown in FIGS. 7A to 7C, at least one pair of electrodes 23 are disposed, one on each side of the ingot 1 with gaps between them and both surfaces of the metal-bonded grindstone 12*a*, and using the metal-bonded grindstone 12*a* as the positive electrode, DC voltage pulses are applied between the positive electrode and the electrodes 23, and at the same time, a conducting processing fluid 25 is supplied between the metal-bonded grindstone 12*a* and the electrodes 23. Thus the metal-bonded grindstone 12*a* cuts the cylindrical ingot 1, and simultaneously, the surfaces of the metal-bonded grindstone 12 are electrically dressed on both sides.

Figure 8:
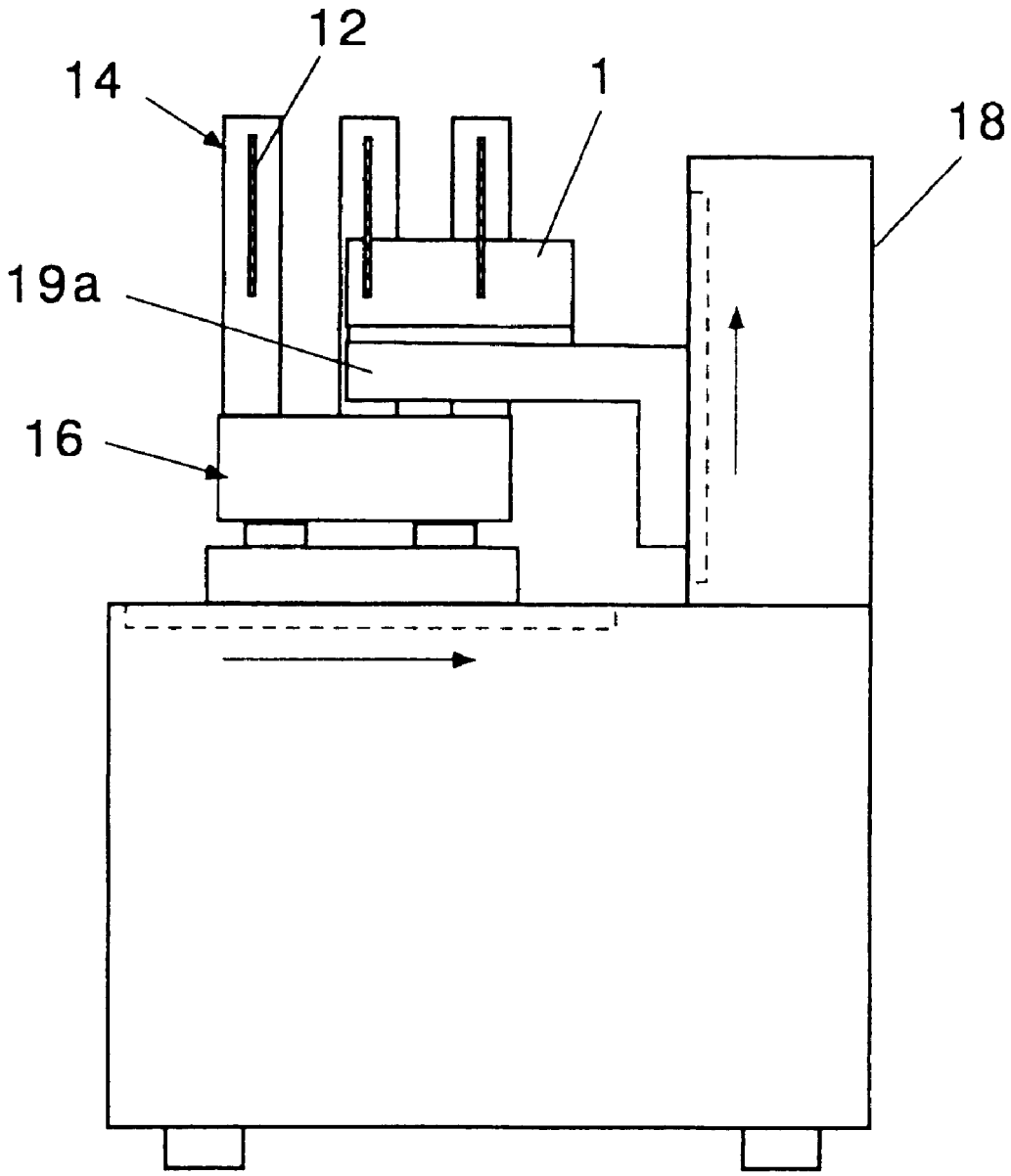
FIG. 8 shows another embodiment of the ingot cutting apparatus according to the present invention.

FIG. 8 shows another configuration of the ingot cutting apparatus according to the present invention. In this embodiment, the tensioning mechanism 14 holds a plurality of strip-shaped grindstones 12 (in this example, three grindstones) parallel to each other, and the plurality of strip-shaped grindstones cut an ingot at multiple positions, thereby the cutting speed is further increased. The other details of this configuration are the same as those shown in FIGS. 5 to 7.

According to the above-mentioned apparatus and methods of the present invention, because the strip-shaped grindstone 12 moves with a longitudinal reciprocating motion and cuts the cylindrical ingot 1, large diameter, hard, refractory ingots (for instance, single crystal SiC ingots) can be cut efficiently. Comparing to conventional means using an outer or inner edge disk cutter, the edge cutting (strip-shaped) grindstone by the present invention is smaller and cheaper, so running costs can be reduced.

In addition, since the strip-shaped grindstone 12 is kept under tension and maintained flat, a strip-shaped grindstone as thin as, for instance, 0.2 to 0.3 mm can be used. Because the runout of the grindstone can be made small, there is less cutting waste than in conventional methods, and warping and uneven thickness of the finished surface can also be reduced. In addition the strip-shaped grindstone 12 is less likely to be broken than a wire saw, so that costly losses of ingots (single crystal SiC, for example) can be remarkably decreased.

Furthermore, the first embodiment of the apparatus and methods according to the present invention can use the so-called electrolytic in-process dressing (ELID) grinding method wherein both surfaces of the metal-bonded grindstone 12*a* can be electrolytically dressed while the ingot 1 is being cut. Therefore, as the grinding grains are sharpened by electrolytic dressing, even a hard, single crystal SiC ingot can be efficiently cut.

Also because the surface of the metal-bonded grindstone can be very precisely sharpened by means of this electrolytic dressing, fine grinding grains can be used, so the cut surface can be finished to be nearly as flat as a mirror surface. Moreover, the need for subsequent processing (polishing) can be significantly reduced, and also damage to the crystal during processing can be reduced to a minimum.

As described above, the ingot cutting apparatus and cutting method according to the present invention provide various advantages such as that a large diameter hard, refractory ingot can be efficiently cut with a small amount of cutting waste, reduced warping and uneven thickness of the finished surface, small roughness of the cut surface, small amount of damage to the crystal during processing, reduced running costs, and reduction in manpower requirements.

Although the present invention has been explained referring to several preferred embodiments, the scope of rights covered by the present invention should not be understood to be limited only to these embodiments. Conversely, the scope of the rights in the present invention should include all modifications, corrections and equivalent entities included in the scope of the attached claims.

What is claimed is:

1. An ingot cutting apparatus comprising:

a thin, strip-shaped grindstone;

a tensioning mechanism that applies a tension to the strip-shaped grindstone and holds the grindstone in a flat state;

a reciprocating device that gives the strip-shaped grindstone a reciprocating motion in the longitudinal direction thereof; and a cutting device that moves the strip-shaped grindstone in a direction radial to a cylindrical ingot and cuts the ingot.

2. The ingot cutting apparatus specified in claim 1, wherein the tensioning mechanism comprises a pair of fixing components that are fixed to both ends of the strip-shaped grindstone, and a pulling component that pulls the fixing components outwards in the longitudinal direction of the strip-shaped grindstone, and the reciprocating device comprises a double-action bed that gives the tensioning mechanism a reciprocating movement in the horizontal or vertical direction, and the cutting device comprises a moving device that supports the ingot and moves the ingot in a direction parallel to the surfaces of the grindstone.

3. The ingot cutting apparatus specified in claim 1, wherein the tensioning mechanism supports a plurality of strip-shaped grindstones parallel to each other.

4. The ingot cutting apparatus specified in claim 1, wherein the strip-shaped grindstone is a metal-bonded grindstone, and in addition, there are at least one pair of electrodes disposed with gaps between the electrodes and both surfaces of the metal-bonded grindstone and one on each side of the ingot, a means of applying a voltage that applies DC voltage pulses between the electrodes and the metal-bonded grindstone, wherein the metal-bonded grindstone is the positive electrode, and a means of feeding processing fluid) that supplies a conducting processing fluid to the gaps between the metal-bonded grindstone and the electrodes so that while the metal-bonded grindstone cuts the cylindrical ingot, both surfaces of the metal-bonded grindstone are simultaneously dressed electrolytically on both sides thereof.

5. The ingot cutting apparatus specified in claim 4, wherein the strip-shaped grindstone comprises a metal strip and a metal-bonded grindstone is formed by electric casting along the edge thereof.

6. An ingot cutting method comprising the steps of:

providing a cylindrical ingot;

providing a thin strip-shaped grindstone supported under tension and maintaining the grindstone flat;

giving the strip-shaped grindstone a reciprocating motion in the longitudinal direction; and moving the strip-shaped grindstone in a direction perpendicular to the cylindrical ingot so the strip-shaped grindstone cuts the ingot.

7. The ingot cutting method specified in claim 6, wherein the strip-shaped grindstone is a metal-bonded grindstone, and the method further comprises:

providing at least one pair of electrodes disposed adjacent to both surfaces of the metal-bonded grindstone, one on each side of the ingot;

applying DC voltage pulses to the electrodes with the metal-bonded grindstone being the positive electrode, and simultaneously, feeding a conducting processing fluid to gaps between the metal-bonded grindstone and the electrodes, and while the cylindrical ingot is cut by the metal-bonded grindstone, at the same time both surfaces of the metal-bonded grindstone are dressed electrolytically on both sides thereof.

8. The ingot cutting apparatus specified in claim 2, wherein the strip-shaped grindstone is a metal-bonded grindstone, and the ingot cutting apparatus further comprises:

at least one pair of electrodes disposed, one on each side of the ingot, with gaps between the electrodes and both surfaces of the metal-bonded grindstone;

a means of applying a voltage that applies DC voltage pulses between the electrodes and the metal-bonded grindstone, wherein the metal-bonded grindstone is the positive electrode; and a means of feeding processing fluid that supplies a conducting processing fluid to the gaps between the metal-bonded grindstone and the electrodes so that while the metal-bonded grindstone cuts the cylindrical ingot, both surfaces of the metal-bonded grindstone are simultaneously dressed electrolytically on both sides thereof.

9. The ingot cutting apparatus specified in claim 3, wherein the strip-shaped grindstone is a metal-bonded grindstone, and the ingot cutting apparatus further comprises:

at least one pair of electrodes disposed, one on each side of the ingot, with gaps between the electrodes and both surfaces of the metal-bonded grindstone;

a means of applying a voltage that applies DC voltage pulses between the electrodes and the metal-bonded grindstone, wherein the metal-bonded grindstone is the positive electrode; and a means of feeding processing fluid that supplies a conducting processing fluid to the gaps between the metal-bonded grindstone and the electrodes so that while the metal-bonded grindstone cuts the cylindrical ingot, both surfaces of the metal-bonded grindstone are simultaneously dressed electrolytically on both sides thereof.

10. The ingot cutting apparatus specified in claim 8, wherein the strip-shaped grindstone comprises a metal strip, and a metal-bonded grindstone that is formed by electric casting along the edge thereof.

11. The ingot cutting apparatus specified in claim 9, wherein the strip-shaped grindstone comprises a metal strip, and a metal-bonded grindstone that is formed by electric casting along the edge thereof.

* * * * *